US006931887B2

(12) United States Patent
Ogata et al.

(10) Patent No.: US 6,931,887 B2
(45) Date of Patent: Aug. 23, 2005

(54) EJECTOR DECOMPRESSION DEVICE

(75) Inventors: Gota Ogata, Obu (JP); Hirotsugu Takeuchi, Nagoya (JP); Yasuhiro Yamamoto, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/921,034

(22) Filed: Aug. 18, 2004

(65) Prior Publication Data

US 2005/0044881 A1 Mar. 3, 2005

(30) Foreign Application Priority Data

Aug. 26, 2003 (JP) ..... 2003-301427
Jun. 8, 2004 (JP) ..... 2004-170078

(51) Int. Cl.[7] ..... F25B 1/06
(52) U.S. Cl. ..... 62/500; 62/511
(58) Field of Search ..... 62/500, 511, 278, 62/191, 116

(56) References Cited

U.S. PATENT DOCUMENTS 6,438,993 B2 * 8/2002 Takeuchi et al. ..... 62/500
6,550,265 B2 * 4/2003 Takeuchi et al. ..... 62/324.2
6,584,794 B2 * 7/2003 Takeuchi et al. ..... 62/278

* cited by examiner

*Primary Examiner*—Melvin Jones
(74) *Attorney, Agent, or Firm*—Harness, Dickey & Pierce, PLC

(57) ABSTRACT

An ejector decompression device for a refrigerant cycle includes a nozzle which decompresses refrigerant flowing out of a refrigerant radiator, and a pressure increasing portion which increases a pressure of refrigerant while refrigerant jetted from the nozzle and refrigerant drawn from an evaporator are mixed. In the ejector cycle, a coaxial degree of the nozzle with respect to the pressure increasing portion is in a range between 0–30% of an inlet diameter of the pressure increasing portion. Alternatively, the pressure increasing portion has a taper portion at least in a predetermined range from the inlet of the pressure increasing portion, and the taper portion is provided to increase a passage sectional area from the inlet of the pressure increasing portion. Accordingly, collision of high-speed refrigerant jetted from the nozzle to an inner wall surface of the pressure increasing portion can be restricted.

11 Claims, 8 Drawing Sheets

EJECTOR DECOMPRESSION DEVICE

CROSS-REFERENCE TO RELATED APPLICATION

This application is related to and claims priority from Japanese Patent Applications No. 2003-301427 filed on Aug. 26, 2003 and No. 2004-170078 filed on Jun. 8, 2004, the contents of which are hereby incorporated by reference.

BACKGROUND OF THE INVENTION

1. Field of the Invention

The present invention relates to an ejector decompression device that is suitably used for a vapor compression refrigerant cycle in which high-temperature and high-pressure refrigerant compressed in a compressor is cooled in a refrigerant radiator and low-temperature and low-pressure refrigerant after being decompressed is evaporated in an evaporator. More particularly, the present invention relates to an ejector structure of an ejector cycle.

2. Description of Related Art

An ejector of an ejector cycle is a kinetic pump (JIS Z 8126(1994) No. 2.1.2.3) including a nozzle in which refrigerant is decompressed to generate a high-speed refrigerant flow, and a pressure increasing portion. In the pressure increasing portion, refrigerant is drawn by entrainment function of high-speed refrigerant (drive refrigerant) jetted from the nozzle, and pressure of refrigerant is increased by concerting speed energy to pressure energy while the drawn refrigerant from the evaporator and the drive refrigerant from the nozzle are mixed.

In the ejector cycle, pressure of refrigerant to be sucked into the compressor is increased by converting expansion energy to pressure energy in the ejector, thereby reducing motive power consumed by the compressor. Further, refrigerant is circulated into the evaporator of the ejector cycle by using the pumping function of the ejector. However, when energy converting efficiency of the ejector, that is, ejector efficiency is reduced, the pressure of refrigerant to be sucked to the compressor cannot be sufficiently increased by the ejector. In this case, the motive power consumed by the compressor cannot be sufficiently reduced.

Further, when an axial line of the nozzle is largely offset from an axial line of the pressure increasing portion, high-speed refrigerant jetted from the nozzle collides with an inner wall surface of the pressure increasing portion, and the refrigerant flow is disturbed. In this case, eddy loss is caused due to the disturbed refrigerant flow, and the ejector efficiency is decreased.

SUMMARY OF THE INVENTION

In view of the foregoing problems, it is an object of the present invention to provide an ejector decompression device which can sufficiently increase ejector efficiency.

It is another object of the present invention to provide an ejector decompression device which effectively restricts eddy loss from being caused therein.

According to an aspect of the present invention, an ejector decompression device for a vapor compression refrigerant cycle includes a nozzle which decompresses refrigerant flowing out of a refrigerant radiator by converting pressure energy of the refrigerant to speed energy thereof, and a pressure increasing portion which increases a pressure of refrigerant by converting the speed energy of the refrigerant to the pressure energy thereof while refrigerant jetted from the nozzle to an inlet of the pressure increasing portion and refrigerant drawn from an evaporator are mixed. In the ejector cycle, a coaxial degree of the nozzle with respect to the pressure increasing portion is equal to or lower than 30% of a diameter of the pressure increasing portion at the inlet of the pressure increasing portion. Accordingly, it can restrict high-speed refrigerant flow jetted from the nozzle from colliding with an inner wall surface of the pressure increasing portion, thereby restricting a refrigerant flow disturbance due to the collision. As a result, it can restrict eddy loss from being caused, and a necessary ejector efficiency can be readily maintained. Generally, the coaxial degree of the nozzle with respect to the pressure increasing portion is in a range of 0.3%–30% of the diameter of the pressure increasing portion at the inlet of the pressure increasing portion.

Preferably, the coaxial degree of the nozzle with respect to the pressure increasing portion is equal to or lower than 20% of the diameter of the pressure increasing portion at the inlet of the pressure increasing portion. More preferably, the coaxial degree of the nozzle with respect to the pressure increasing portion is equal to or lower than 15% of the diameter of the pressure increasing portion at the inlet of the pressure increasing portion. In this case, the collision of the high-speed refrigerant jetted from the nozzle can be more effectively restricted.

Alternatively, the pressure increasing portion has a taper portion at least in a predetermined range from the inlet of the pressure increasing portion, and the taper portion is provided to increase a passage sectional area from the inlet of the pressure increasing portion toward an outlet of the pressure increasing portion. In this case, it can restrict high-speed refrigerant flow jetted from the nozzle from colliding with an inner wall surface of the pressure increasing portion, thereby restricting a refrigerant flow disturbance due to the collision. As a result, it can restrict eddy loss from being caused, and a necessary ejector efficiency can be readily maintained.

Generally, the pressure increasing portion includes a mixing portion in which the refrigerant jetted from the nozzle and the refrigerant drawn from the evaporator are mixed, and a diffuser which changes kinetic pressure of refrigerant to static pressure thereof. Further, the predetermined range of the taper portion is approximately equal to or larger than 10 times of the diameter at the inlet of the pressure increasing portion. In this case, the ejector efficiency can be further improved.

Preferably, the nozzle has a center axial line (L1) that is crossed with a center axial line (L2) of the pressure increasing portion by an offset angle ($\theta$), and a taper angle ($\alpha$) of the taper portion is set to be equal to or larger than twice of the offset angle ($\theta$).

In the present invention, generally, the coaxial degree is an offset distance of the center axial line (L1) of the nozzle with respect to the center axial line (L2) of the pressure increasing portion at a predetermined position (e.g., the inlet) of the pressure increasing portion.

BRIEF DESCRIPTION OF THE DRAWINGS

Additional objects and advantages of the present invention will be more readily apparent from the following detailed description of a preferred embodiment when taken together with the accompanying drawings, in which.

DETAILED DESCRIPTION OF THE PRESENTLY PREFERRED EMBODIMENTS

Preferred embodiments of the present invention will be described hereinafter with reference to the appended drawings.

First Embodiment

Figure 1:
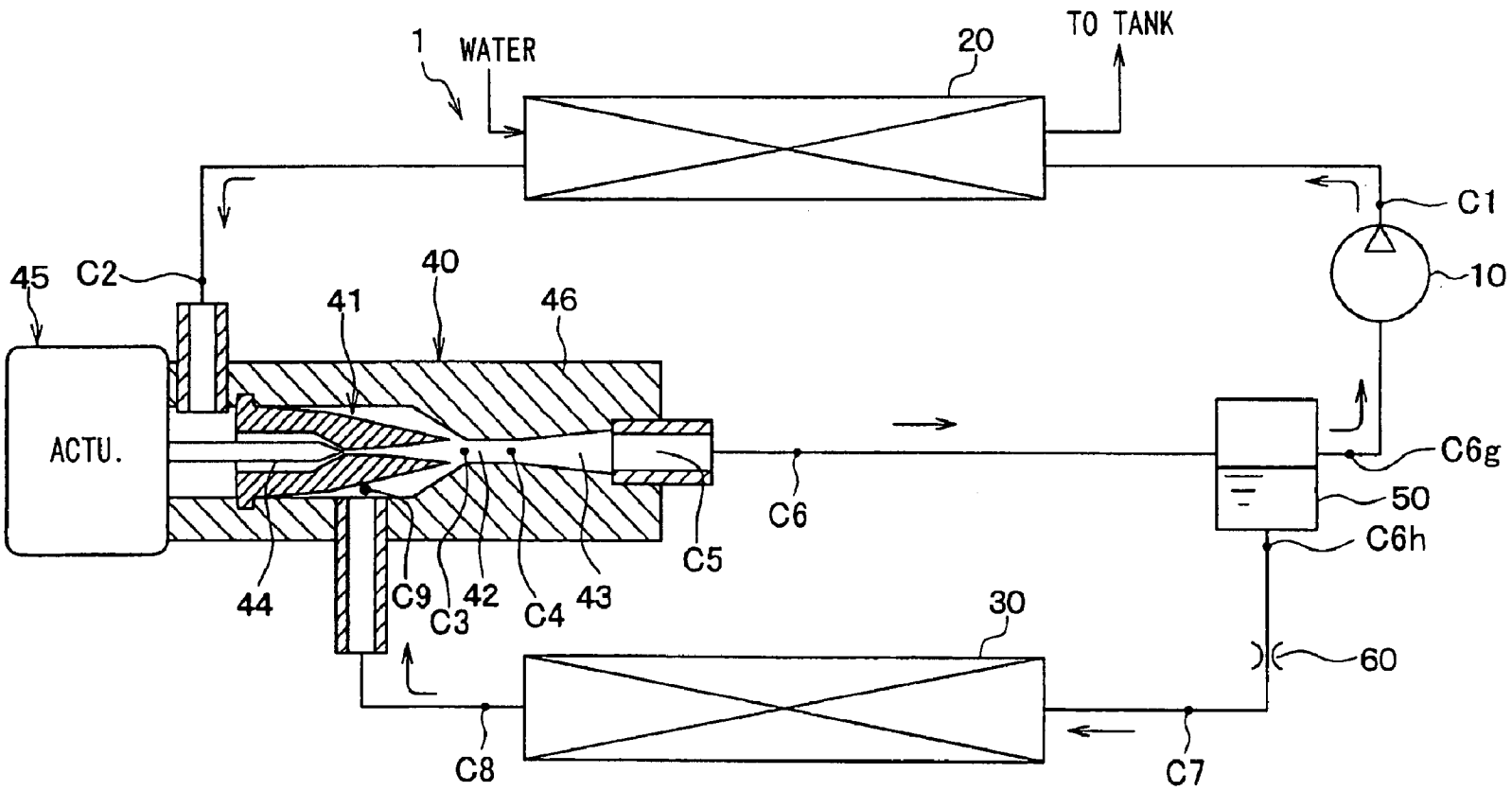
FIG. 1 is a schematic diagram showing an ejector cycle according to embodiments of the present invention.

In the first embodiment, an ejector (ejector decompression device) of an ejector cycle is typically used for a water heater. In the ejector cycle shown in FIG. 1, fluorocarbon (Freon, R404a) or carbon dioxide or the like can be used as a refrigerant.

In the ejector cycle, a compressor 10 sucks and compresses refrigerant. The compressor 10 is driven by an electrical motor (not shown), and a rotation speed of the compressor 10 is controlled so that a refrigerant temperature or a refrigerant pressure discharged from the compressor 10 becomes a predetermined value. That is, a refrigerant amount discharged from the compressor 10 is controlled by controlling the electrical motor.

A water-refrigerant heat exchanger 20 (refrigerant radiator, high-pressure heat exchanger) is disposed to perform heat exchange between the refrigerant discharged from the compressor 10 and water to be supplied to a tank. Therefore, in the water-refrigerant heat exchanger 20, water to be supplied to the tank is heated, and the refrigerant discharged from the compressor 10 is cooled. Generally, a flow direction of the water flowing in the water-refrigerant heat exchanger 20 is opposite to a flow direction of the refrigerant flowing therein.

For example, when Freon is used as the refrigerant, the refrigerant discharged from the compressor 10 is cooled and condensed in the water-refrigerant heat exchanger 20. In contrast, when carbon dioxide is used as the refrigerant, high-pressure side refrigerant pressure becomes equal to or higher than the critical pressure of the refrigerant. In this case, a refrigerant temperature decreases from a refrigerant inlet to a refrigerant outlet of the water-refrigerant heat exchanger 20 while the refrigerant discharged from the compressor 10 is not condensed in the water-refrigerant heat exchanger 20.

An evaporator 30 is disposed to evaporate liquid refrigerant. Specifically, the evaporator 30 is a low-pressure heat exchanger (heat absorber) that evaporates the liquid refrigerant by absorbing heat from exterior air.

An ejector 40 sucks refrigerant evaporated in the evaporator 30 while decompressing and expanding refrigerant flowing from the water-refrigerant heat exchanger 20, and increases pressure of refrigerant to be sucked into the compressor 10 by converting expansion energy of refrigerant to pressure energy thereof.

A gas-liquid separator 50 separates the refrigerant from the ejector 40 into gas refrigerant and liquid refrigerant, and stores the separated refrigerant therein. The gas-liquid separator 50 includes a gas-refrigerant outlet connected to a suction port of the compressor 10, and a liquid-refrigerant outlet connected to an inlet side of the evaporator 30. A throttle 60 is disposed in a refrigerant passage between the liquid-refrigerant outlet of the gas-liquid separator 50 and the inlet side of the evaporator 30, so that liquid refrigerant supplied from the gas-liquid separator 50 to the evaporator 30 is decompressed.

Figure 2:
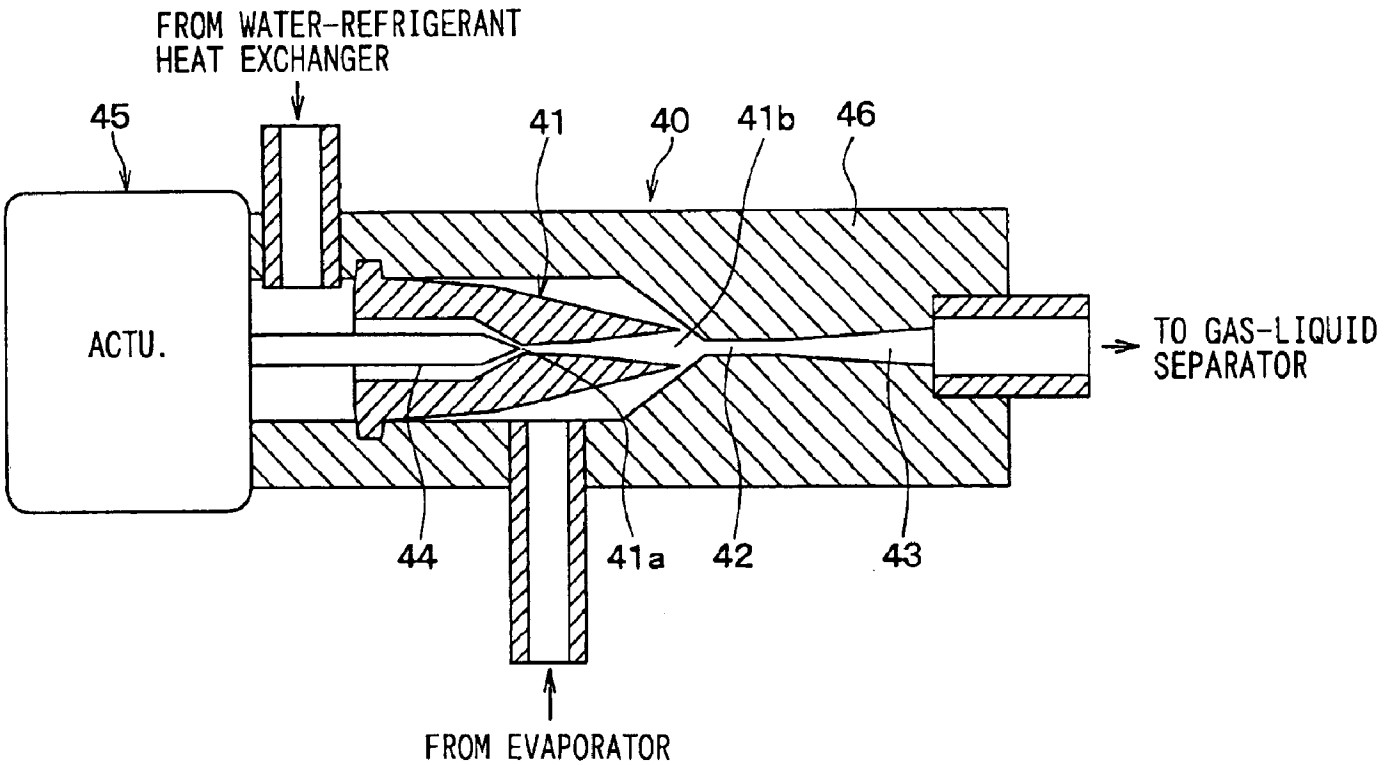
FIG. 2 is a schematic sectional view showing an example of an ejector (ejector decompression device) according to a first embodiment of the present invention.
Figure 3:
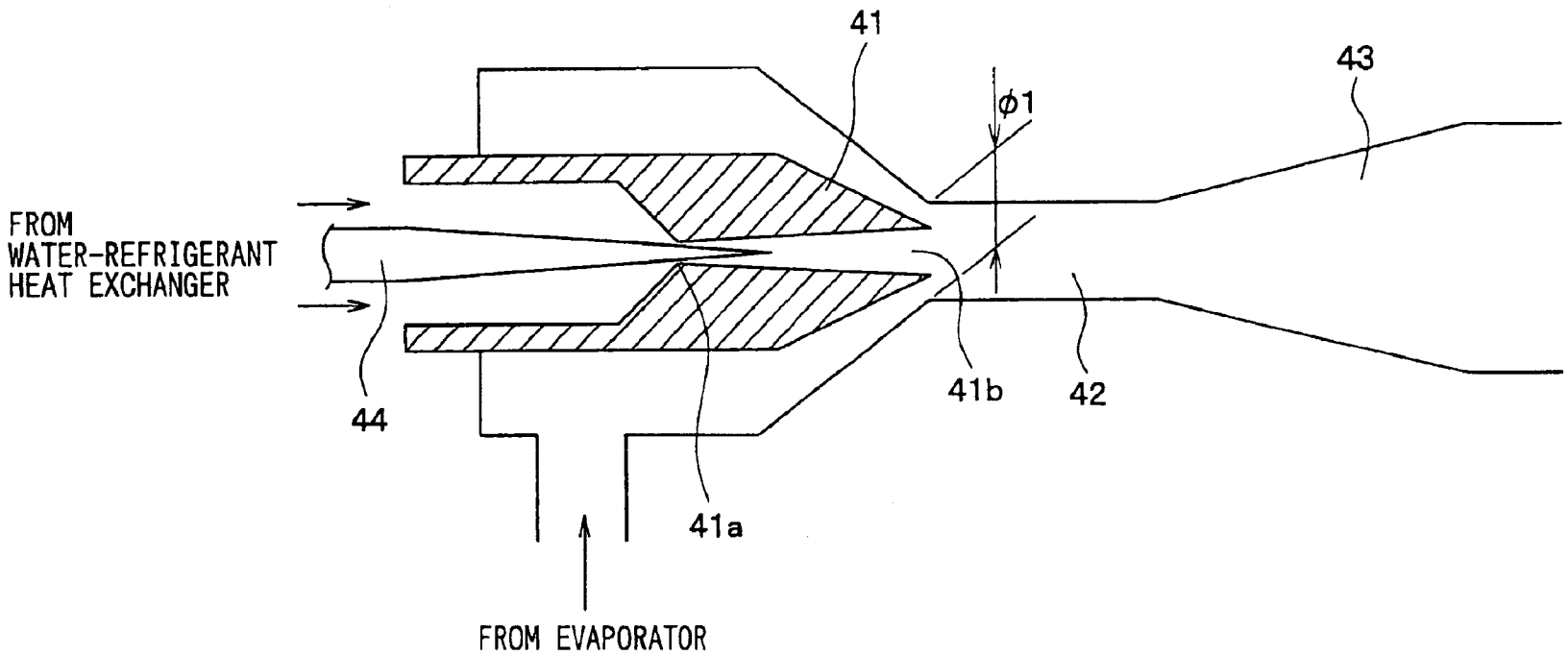
FIG. 3 is a schematic sectional view showing another example of the ejector of the first embodiment.

Next, the structure of the ejector 40 will be now described in detail with reference to FIG. 2. As shown in FIG. 2, the ejector 40 includes a nozzle 41, a mixing portion 42 and a diffuser 43. The nozzle 41 decompresses and expands high-pressure refrigerant from the water-refrigerant heat exchanger 20 in iso-entropy by converting pressure energy of the high-pressure refrigerant to speed energy. Gas refrigerant from the evaporator 30 is drawn into the mixing portion 42 by a high speed stream of refrigerant jetted from the nozzle 41, and the drawn gas refrigerant and the jetted refrigerant are mixed in the mixing portion 42. The diffuser 43 increases refrigerant pressure by converting the speed energy of refrigerant to the pressure energy of the refrigerant while further mixing the gas refrigerant drawn from the evaporator 30 and the refrigerant jetted from the nozzle 41.

In the mixing portion 42, the refrigerant jetted from the nozzle 41 and the refrigerant drawn from the evaporator 30 are mixed so that the sum of their momentum of two-kind refrigerant flows is conserved. Therefore, static pressure of refrigerant is increased also in the mixing portion 42. Because a sectional area of a refrigerant passage in the diffuser 43 is gradually increased, dynamic pressure of refrigerant is converted to static pressure of refrigerant in the diffuser 43. Thus, refrigerant pressure is increased in both of the mixing portion 42 and the diffuser 43. Accordingly, in this embodiment, a pressure increasing portion is constructed with the mixing portion 42 and the diffuser 43. Theoretically, in the ejector 40, refrigerant pressure is increased in the mixing portion 42 so that the total momentum of two-kind refrigerant flows is conserved in the mixing portion 42, and the refrigerant pressure is further increased in the diffuser 43 so that total energy of refrigerant is conserved in the diffuser 43.

The nozzle 41 is a Laval nozzle having a throat portion 41*a* and an expansion portion 41*b* that is downstream from the throat portion 41*a*. Here, a cross-sectional area of the throat portion 41*a* is smallest in a refrigerant passage of the nozzle 41. As shown in FIG. 2, an inner radial dimension of the expansion portion 41*b* is gradually increased from the throat portion 41*a* toward a downstream end (outlet) of the nozzle 41.

A needle valve 44 is displaced by an actuator 45 in an axial direction of the nozzle 41, so that a throttle open degree of the refrigerant passage of the nozzle 41 is adjusted. That is, an open area of the throat portion 41*a* in the nozzle 41 is adjusted by the displacement of the needle valve 44. At the throat portion 41*a*, the passage sectional area becomes smallest in the nozzle 41. The needle valve 44 has a cone shape at its tip portion. In this embodiment, an electric actuator such as a linear solenoid motor and a stepping motor including a screw mechanism is used as the actuator 45.

Figure 5:
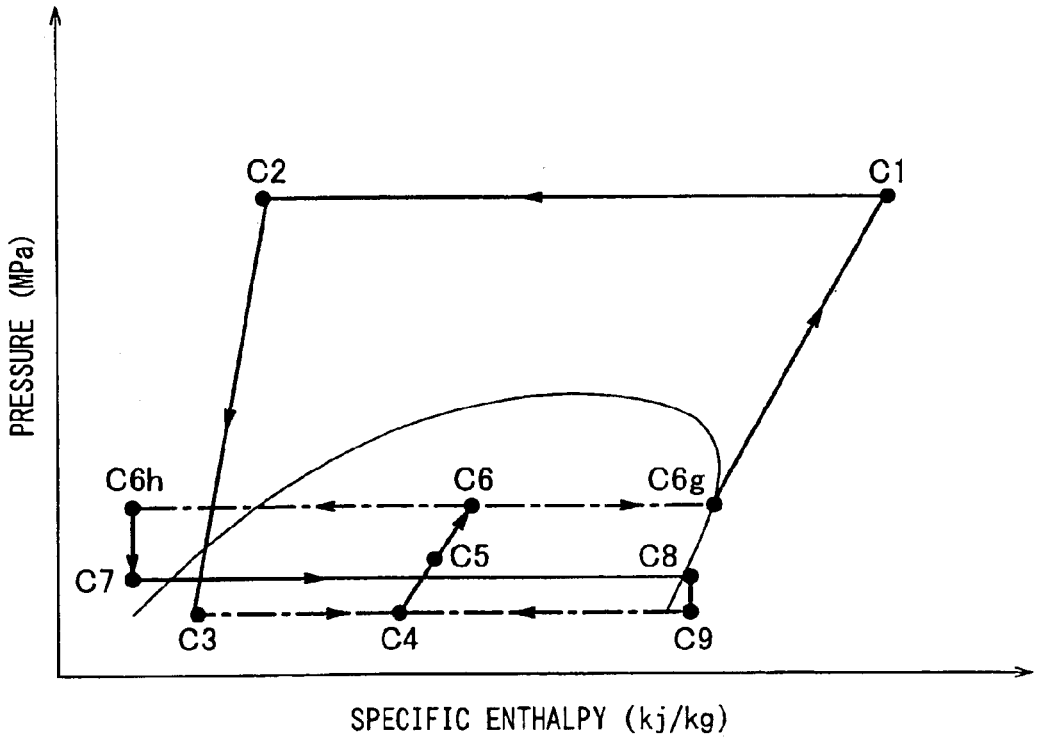
FIG. 5 is a Mollier diagram (p-hdiagram) showing a relationship between a refrigerant pressure and a specific enthalpy in the ejector cycle.

Further, a temperature of the high-pressure refrigerant is detected by a temperature sensor (not shown), and a pressure of the high-pressure refrigerant is detected by a pressure sensor (not shown). Then, the throttle open degree of the nozzle 41 is controlled by the needle valve 44, so that the pressure detected by the pressure sensor becomes a target pressure that is determined based on the detected temperature of the temperature sensor. The temperature sensor is disposed at the high pressure side to detect the temperature of the high-pressure side refrigerant in the ejector cycle. The target pressure is set so that the coefficient of the ejector cycle becomes in maximum, relative to the refrigerant temperature at the high-pressure side in the ejector cycle. As shown in FIG. 5, in a case where the carbon dioxide is used as the refrigerant, when the heat load is high, the pressure of the high-pressure side refrigerant is set higher than the critical pressure of the refrigerant. In this case, the throttle open degree of the nozzle 41 is controlled so that the pressure of the refrigerant flowing into the nozzle 41 becomes equal to or higher than the critical pressure. In contrast, when the heat load is small, the pressure of the refrigerant flowing into the nozzle 41 is set lower than the critical pressure of the refrigerant, the throttle open degree of the nozzle 41 is controlled so that refrigerant flowing into the nozzle 41 has a predetermined super-cooling degree.

Next, operation of the ejector cycle will be now described. In the ejector cycle, reference numbers C1–C9 shown in FIG. 5 indicate refrigerant states at positions indicated by reference numbers C1–C9 shown in FIG. 1, respectively, when carbon dioxide is used as the refrigerant.

In the ejector cycle, refrigerant is compressed in the compressor 10, and is discharged to the water-refrigerant heat exchanger 20 to heat water to be supplied to the water tank. The refrigerant discharged from the compressor 10 is cooled in the water-refrigerant heat exchanger 20, and is decompressed in the nozzle 41 of the ejector 40 generally in iso-entropy. The flow speed of the refrigerant is increased in the nozzle 41 of the ejector 40 to be equal to or more than the sound speed at the outlet of the nozzle 41, and flows into the mixing portion 42 of the ejector 40. Further, gas refrigerant evaporated in the evaporator 30 is drawn into the mixing portion 42 of the ejector 40 by the pumping function due to the entrainment function of the high-speed refrigerant flowing from the nozzle 41 into the mixing portion 42. The refrigerant sucked from the evaporator 30 and the refrigerant injected from the nozzle 41 are mixed in the mixing portion 42, and flows into the gas-liquid separator 50 after the dynamic pressure of the refrigerant is converted to the static pressure of the refrigerant in the diffuser 43. Therefore, low-pressure side refrigerant circulates from the gas-liquid separator 50 to the gas-liquid separator 50 through the throttle 60, the evaporator 30 and the pressure increasing portion of the ejector 40 in this order.

Figure 4:
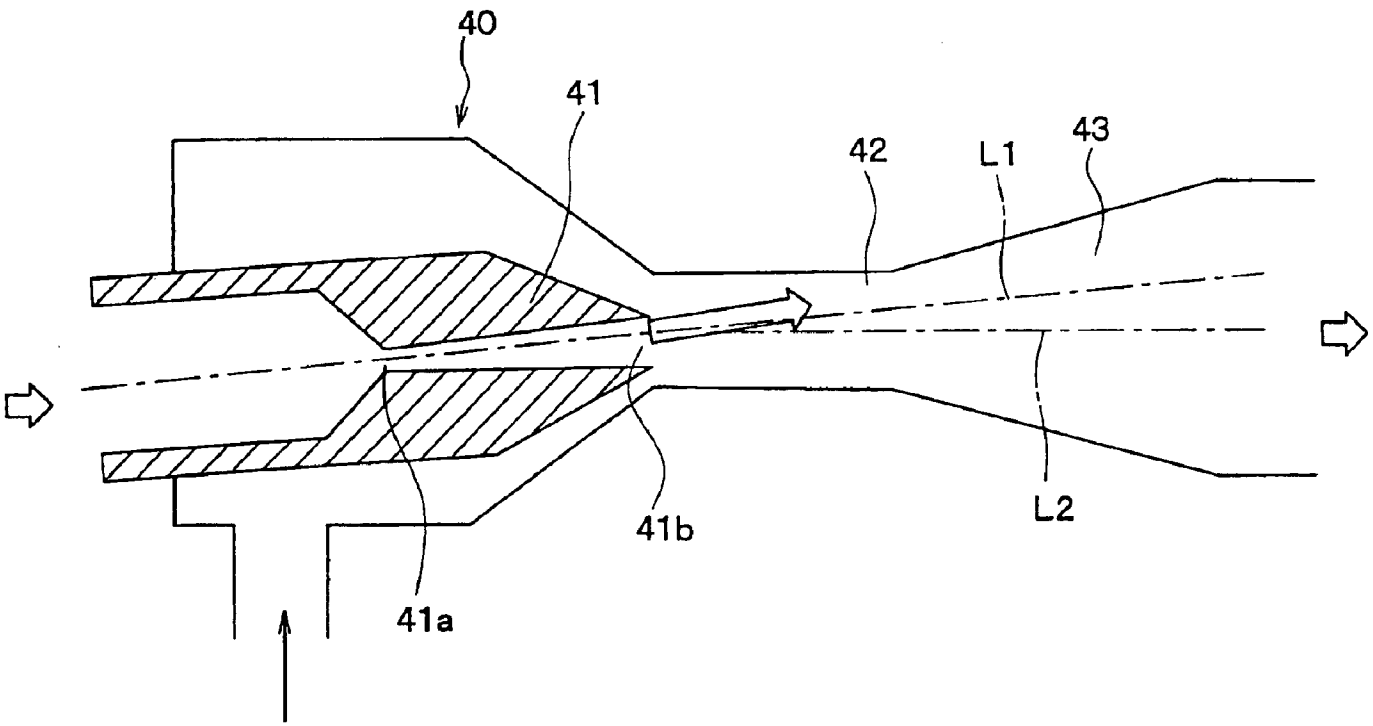
FIG. 4 is a schematic sectional view showing an ejector example for explaining the present invention.

Next, a coaxial degree of the nozzle 41 with respect to a mixing portion 42 (pressure increasing portion) will be described with reference to FIGS. 4, 7A and 7B. As shown in FIG. 4, when a center axial line L1 of the nozzle 41 is offset from a center axial line L2 of the mixing portion 42, high-speed refrigerant jetted from the nozzle 41 collides with the inner wall surface of the pressure increasing portion. Accordingly, in this embodiment, an offset amount (offset distance) of the center axial line L1 of the nozzle 41 from the center axial line L2 of the mixing portion 42 at an inlet of the mixing portion 42 is set to be equal to or lower than 30% of an inlet diameter $\phi 1$ of the mixing portion 42 at the inlet of the mixing portion 42, so that the collision of the high-speed refrigerant jetted from the nozzle 41 to the inner wall surface of the mixing portion 42 (pressure increasing portion) is effectively restricted. That is, as shown in FIG. 2, the nozzle 41 is disposed in a body 46 for forming the pressure increasing portion so that the coaxial degree of the nozzle 41 with respect to the mixing portion 42 becomes equal to or lower than 30% of the inlet diameter $\phi 1$ of the mixing portion 42.

Figure 7A:
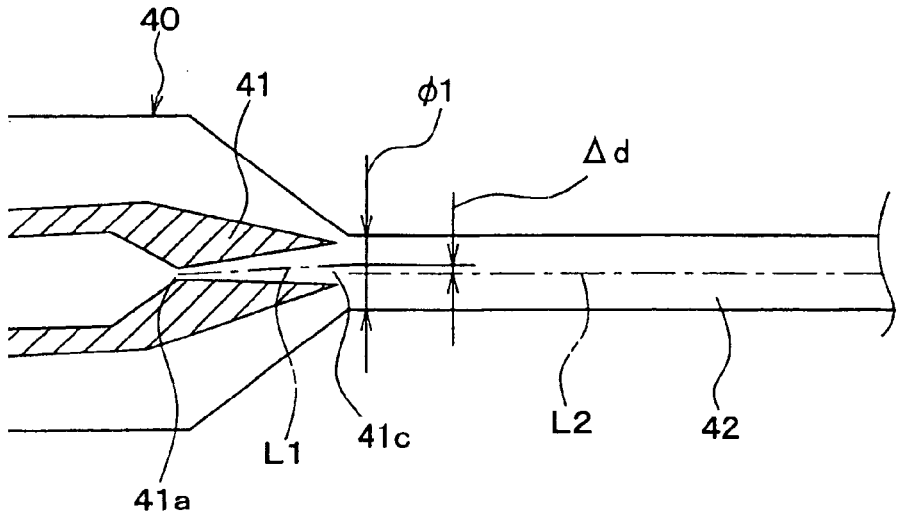
FIGS. 7A and 7B are schematic sectional views for explaining the coaxial degree of the present invention.

FIG. 7A shows a case where the nozzle 41 is a bell nozzle in which a passage sectional area is enlarged from the throat portion 41*a* toward a refrigerant jetting portion 41*c* of the nozzle 41. FIG. 7B shows a case where the nozzle 41 is a tapered nozzle in which a passage sectional area at the throat portion 41*a* is close to the refrigerant jetting portion 41*c*.

In FIG. 7A, Ad indicates the offset amount of the center axial line L1 of the nozzle 41 relative to the center axial line L2 of the mixing portion 42 at the inlet of the mixing portion 42. Generally, the coaxial degree of the nozzle 41 with respect to the mixing portion 42 is indicated by the offset amount (tolerance). Further, the present invention can be used for various kinds of ejectors. Accordingly, in this embodiment, the coaxial degree is defined by percentage ($\Delta d/\phi 1$) of the offset amount $\Delta d$ with respect to the inlet diameter $\phi 1$ of the mixing portion 42.

Figure 7B:
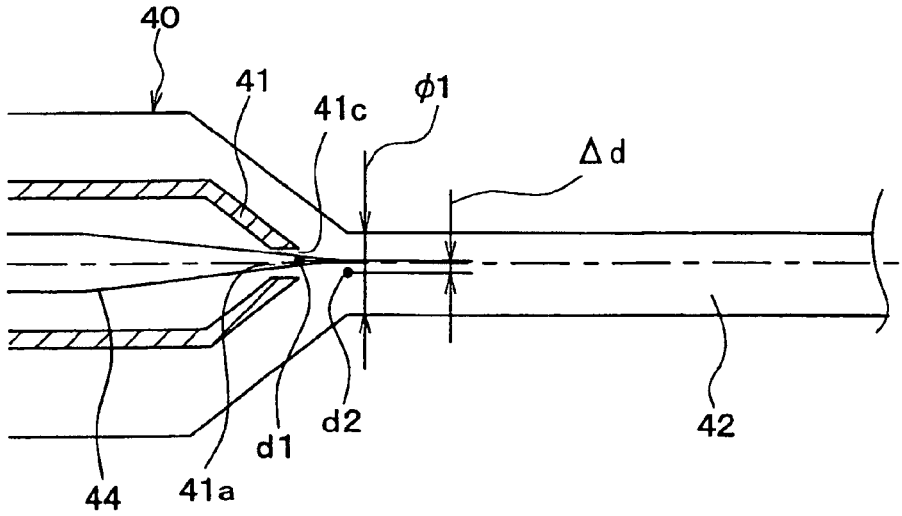

Similarly, in FIG. 7B, $\Delta d$ indicates an offset amount (offset distance) of a center d1 of the refrigerant jetting port 41*c* of the nozzle 41 with respect to a center d2 of the mixing portion 42 at the inlet of the mixing portion 42. Further, similarly to FIG. 7A, the coaxial degree is defined by percentage ($\Delta d/\phi 1$) of the offset amount $\Delta d$ with respect to the inlet diameter $\phi 1$ of the mixing portion 42.

In the first embodiment, the center axial line L1 (the center d1) of the nozzle 41 and the center axial line L2 (the center d2) of the mixing portion 42 are measured at the inlet of the mixing portion 42, and the offset amount $\Delta d$ is calculated using the center axial line L1 (the center d1) of the nozzle 41 and the center axial line L2 (the center d2) of the mixing portion 42 at the inlet of the mixing portion 42. However, the center axial line L1 (the center d1) of the nozzle 41 and the center axial line L2 (the center d2) of the mixing portion 42 can be measured at the other portion of the mixing portion 42, and the offset amount $\Delta d$ can be calculated. For example, the center axial line L1 (the center d1) of the nozzle 41 and the center axial line L2 (the center d2) of the mixing portion 42 are measured at an outlet portion of the mixing portion 42.

In this embodiment, the dimension of the nozzle 41 or/and the body 46 and assemble position of the nozzle 41 into the body 46 are controlled so that the coaxial degree is set in a predetermined range (e.g., 3–30%).

Figure 6:
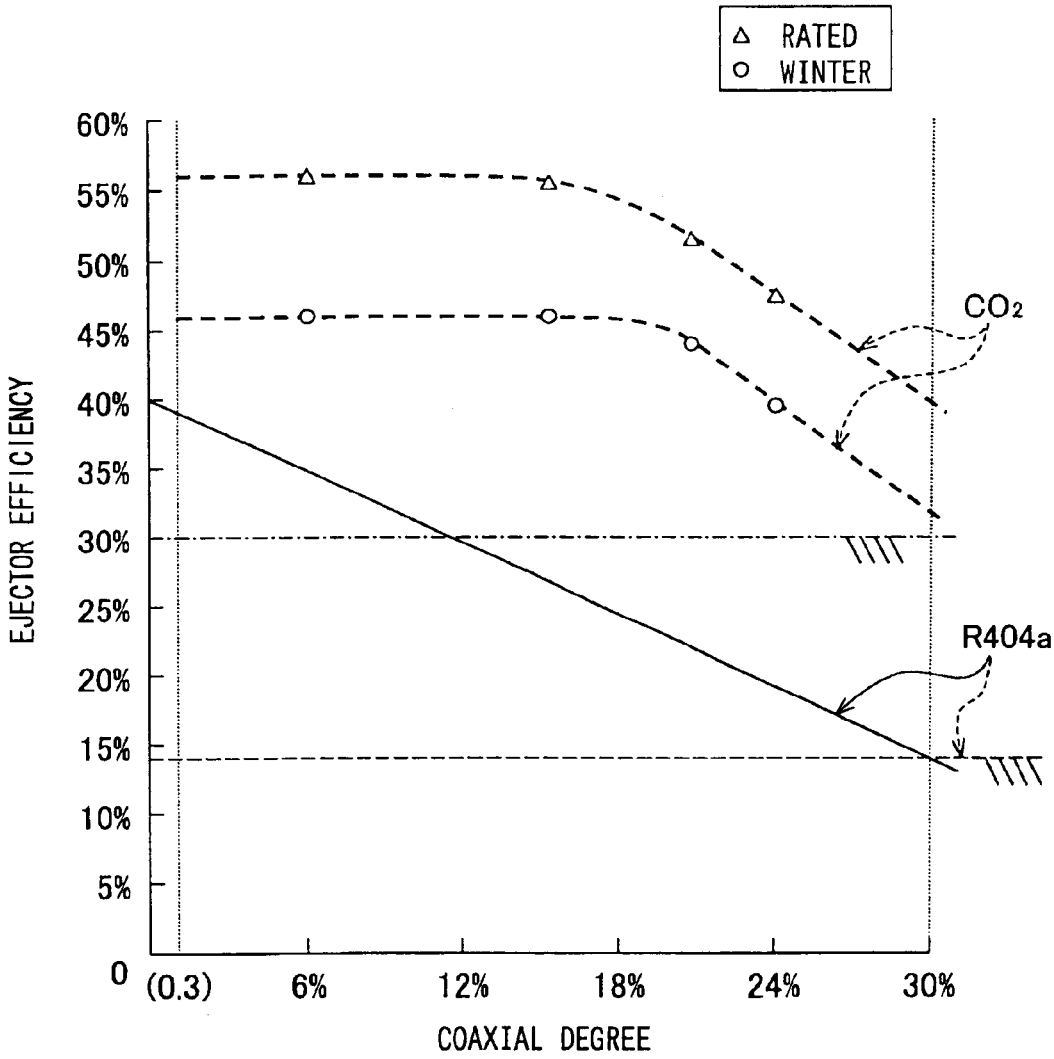
FIG. 6 is a graph showing a relationship between a coaxial degree and an ejector efficiency according to the first embodiment.

FIG. 6 shows experiment results in the ejector cycle performed by inventors of the present invention by using an experiment method prescribed in Japan Refrigerator Association. In FIG. 6, when the carbon dioxide is used, the relationships between the ejector coefficient and the coaxial degree are indicated in a rated experiment condition and in a winter experiment condition. Further, when R404a (Freon) is used as the refrigerant, the relationship between the ejector coefficient and the coaxial degree is indicated in a rated experiment condition.

As shown in FIG. 6, in a case where carbon dioxide is used as the refrigerant, when the nozzle 41 is assembled to the body 46 (pressure increasing portion) such that the coaxial degree of the nozzle 41 with respect to the mixing portion 42 is equal to or lower than 30% of the inlet diameter $\phi 1$ of the mixing portion 42, at least a necessary ejector efficiency (e.g., more than 30%) necessary in the ejector cycle using carbon dioxide as the refrigerant can be maintained. That is, when the coaxial degree of the nozzle 41 with respect to the mixing portion 42 is equal to or lower than 30% of the inlet diameter $\phi 1$ of the mixing portion 42, it can restrict the high-speed refrigerant flow jetted from the nozzle 41 from colliding with the inner wall surface of the mixing portion 42, thereby restricting eddy loss from being caused. Similarly, in a case where Freon (e.g., R404a) is used as the refrigerant, when the coaxial degree of the nozzle 41 with respect to the mixing portion 42 is equal to or lower than 30% of the inlet diameter $\phi 1$ of the mixing portion 42, at least a necessary ejector efficiency (e.g., more than 13%) necessary in the ejector cycle using R404a as the refrigerant can be maintained.

Further, as shown in FIG. 6, the ejector efficiency can be more effectively improved relative to the coaxial degree, when carbon dioxide is used as the refrigerant as compared with the case where R404a is used as the refrigerant.

Accordingly, in this embodiment, when the coaxial degree of the nozzle 41 with respect to the mixing portion 42 is equal to or lower than 30% of the inlet diameter of the mixing portion 42, the suction pressure of refrigerant to be sucked to the compressor 10 can be sufficiently increased in the ejector 40. Therefore, consumption power of the compressor 10 can be sufficiently reduced, and the coefficient of performance (COP) of the ejector cycle can be improved.

Generally, the coaxial degree is set equal to or more than 0.3% based on the manufacturing limit of the ejector 40. In this embodiment, the coaxial degree of the nozzle 41 with respect to the mixing portion 42 is set in a range of 0.3%–30% of the inlet diameter of the mixing portion 42. In this case, the necessary ejector efficiency of the ejector cycle can be readily maintained.

In the case where the carbon dioxide is used as the refrigerant, when the coaxial degree of the nozzle 41 with respect to the mixing portion 42 is set in a range of 0.3%–30% of the inlet diameter of the mixing portion 42, the pressure of high-pressure side refrigerant before being decompressed in the nozzle 41 of the ejector 40 is about in a range of 8–14 Mpa, and the pressure of low-pressure side refrigerant after being decompressed in the nozzle 41 of the ejector 40 is about in a range of 2–5 Mpa.

In this embodiment, when the coaxial degree of the nozzle 41 with respect to the mixing portion 42 is set in a range of 0.3%–20% of the inlet diameter of the mixing portion 42, the ejector efficiency of the ejector cycle can be improved. More preferably, when the coaxial degree of the nozzle 41 with respect to the mixing portion 42 is set in a range of 0.3%–15% of the inlet diameter of the mixing portion 42, the ejector efficiency of the ejector cycle can be further improved.

Second Embodiment

The second embodiment of the present invention will be now described with reference to FIG. 8.

In the above-described first embodiment, the diameter of the mixing portion 42 is set approximately at a constant value at least in a predetermined range from the inlet of the mixing portion 42. However, in the second embodiment, a taper portion 42*a* is provided in the mixing portion 42, so that a passage sectional area (i.e., diameter) of the mixing portion 42 is enlarged from the inlet of the mixing portion 42 toward an outlet of the mixing portion 42 at least in a predetermined range from the inlet of the mixing portion 42. In the example of FIG. 8, the tater portion 42*a* is provided in an entire range from the inlet of the mixing portion 42 to the outlet of the mixing portion 42. In this case, the passage sectional area (i.e., diameter) of the mixing portion 42 is increased from the inlet of the mixing portion 42 to the outlet of the mixing portion 42.

Because the mixing portion 42 is provided to have the taper portion 42*a*, it can restrict the high-speed refrigerant flow jetted from the nozzle 41 from colliding with the inner wall surface of the mixing portion 42, thereby restricting the eddy loss due to disturbed refrigerant from being caused. As a result, a high ejector efficiency can be readily obtained.

Figure 8:
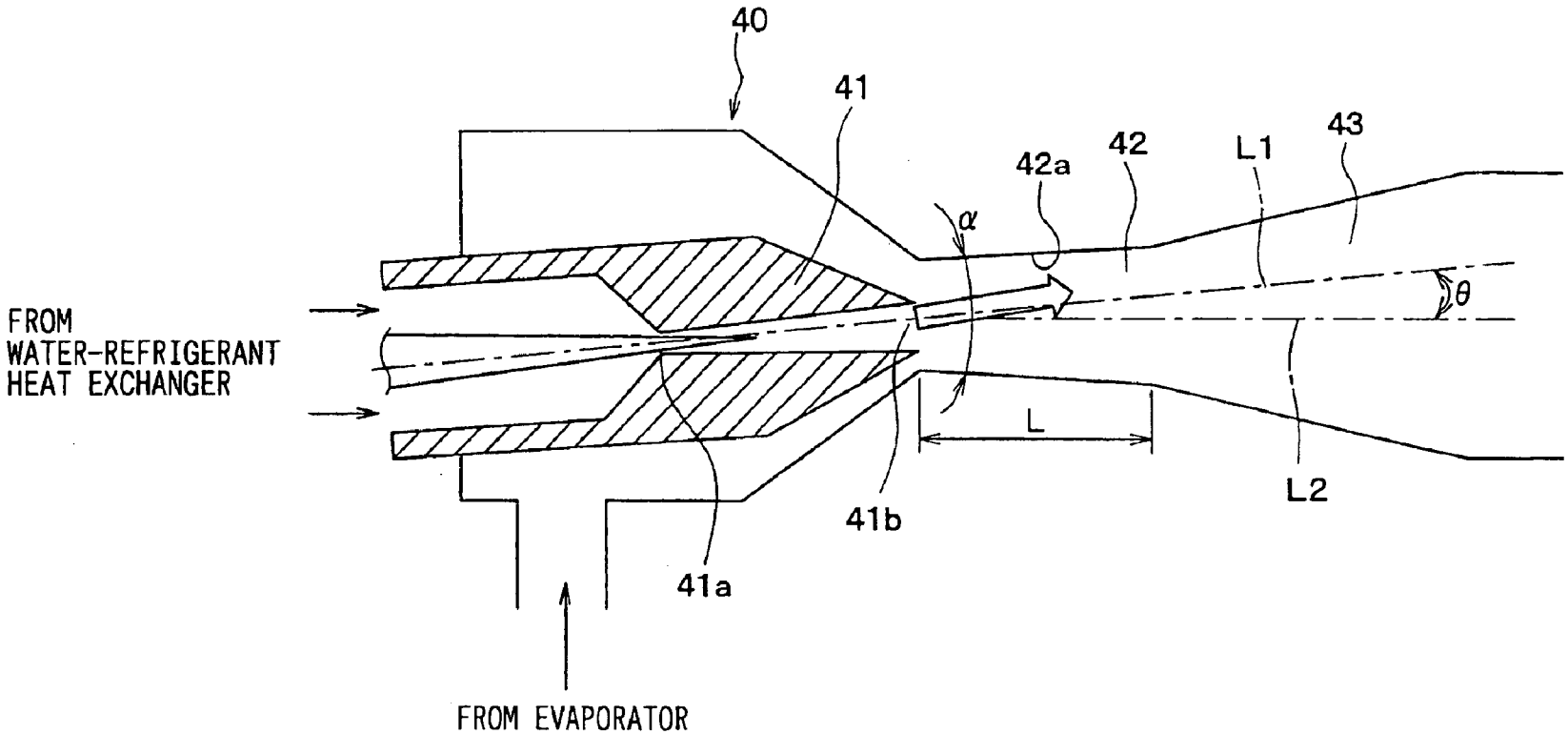
FIG. 8 is a schematic sectional view showing an ejector (ejector decompression device) according to a second preferred embodiment of the present invention.

In the example of FIG. 8, the taper portion 42*a* is provided approximately in the entire area of the mixing portion 42. Generally, the flow speed of the refrigerant from the outlet of the nozzle 41 is higher as closer to the outlet of the nozzle 41, that is, as closer to the inlet of the mixing portion 42. Generally, when the taper portion 42*a* is provided at least in a predetermined range from the inlet of the mixing portion 42 (pressure increasing portion), which is about 10 times or more of the inlet diameter $\phi 1$ of the mixing portion 42, the necessary ejector efficiency can be sufficiently obtained.

Further, in the second embodiment, when the taper angle of the taper portion 42*a* is indicated as $\alpha$, and when the offset angle between the center axial line L1 of the nozzle 41 and the center axial line L2 of the mixing portion 42 is $\theta$, $\alpha \geqq 2\theta$ (i.e., $\frac{1}{2}\alpha \geqq \theta$). In this embodiment, the taper angle $\alpha$ is defined in accordance with JIS B 0612 (1987). That is, when the center axial line L1 of the nozzle 41 is crossed with the center axial line L2 of the pressure increasing portion by the offset angle $\theta$, the taper angle $\alpha$ of the taper portion 42*a* is set to be equal to or larger than twice of the offset angle $\theta$.

The invention described in the second embodiment can be combined with the invention described in the first embodiment.

Other Embodiment

Although the present invention has been fully described in connection with the preferred embodiments thereof with reference to the accompanying drawings, it is to be noted that various changes and modifications will become apparent to those skilled in the art.

In the above-described embodiments, the present invention is typically applied to the water heater. However, the present invention can be applied to another ejector cycle used for an air conditioner and a refrigerator, for example.

In the above-described embodiments, the throttle open degree of the nozzle 41 is variably controlled by using the needle valve 44. However, the present invention can be applied to an ejector without a needle valve. In this case, the ejector has a fixed open degree.

Such changes and modifications are to be understood as being within the scope of the present invention as defined by the appended claims.

What is claimed is:

1. An ejector decompression device for a vapor compression refrigerant cycle that includes a compressor for compressing refrigerant, a refrigerant radiator for cooling refrigerant discharged from the compressor and an evaporator for evaporating low-pressure refrigerant after being decompressed, the ejector decompression device comprising:

a nozzle which decompresses refrigerant flowing out of the refrigerant radiator by converting pressure energy of the refrigerant to speed energy thereof; and a pressure increasing portion which increases a pressure of refrigerant by converting the speed energy of the refrigerant to the pressure energy thereof while refrigerant jetted from the nozzle to an inlet of the pressure increasing portion and refrigerant drawn from the evaporator are mixed, wherein a coaxial degree of the nozzle with respect to the pressure increasing portion is equal to or lower than 30% of a diameter of the pressure increasing portion at the inlet of the pressure increasing portion.

2. The ejector decompression device according to claim 1, wherein the coaxial degree of the nozzle with respect to the pressure increasing portion is equal to or lower than 20% of the diameter of the pressure increasing portion at the inlet of the pressure increasing portion.

3. The ejector decompression device according to claim 2, wherein the coaxial degree of the nozzle with respect to the pressure increasing portion is equal to or lower than 15% of the diameter of the pressure increasing portion at the inlet of the pressure increasing portion.

4. The ejector decompression device according to claim 1, wherein:

the pressure increasing portion has a taper portion at least in a predetermined range from the inlet of the pressure increasing portion; and the taper portion is provided to increase a passage sectional area from the inlet of the pressure increasing portion toward an outlet of the pressure increasing portion.

5. The ejector decompression device according to claim 4, wherein:

the pressure increasing portion includes a mixing portion in which the refrigerant jetted from the nozzle and the refrigerant drawn from the evaporator are mixed, and a diffuser which changes kinetic pressure of refrigerant to static pressure thereof; and the predetermined range of the taper portion is approximately equal to or larger than 10 times of the diameter at the inlet of the pressure increasing portion.

6. The ejector decompression device according to claim 4, wherein:

the nozzle has a center axial line (L1) that is crossed with a center axial line (L2) of the pressure increasing portion by an offset angle (⊖); and a taper angle (a) of the taper portion is set to be equal to or larger than twice of the offset angle (⊖).

7. The ejector decompression device according to claim 1, wherein the coaxial degree of the nozzle with respect to the pressure increasing portion is in a range of 0.3%–30% of the diameter of the pressure increasing portion at the inlet of the pressure increasing portion.

8. The ejector decompression device according to claim 1, wherein the coaxial degree is an offset distance of a center axial line (L1) of the nozzle with respect to a center axial line (L2) of the pressure increasing portion at the inlet of the pressure increasing portion.

9. The ejector compression device according to claim 1, wherein carbon dioxide is used as the refrigerant.

10. An ejector decompression device for a vapor compression refrigerant cycle that includes a compressor for compressing refrigerant, a refrigerant radiator for cooling refrigerant discharged from the compressor and an evaporator for evaporating low-pressure refrigerant after being decompressed, the ejector decompression device comprising:

a nozzle which decompresses refrigerant flowing out of the refrigerant radiator by converting pressure energy of the refrigerant to speed energy thereof: and a pressure increasing portion which increases a pressure of refrigerant by converting the speed energy of the refrigerant to the pressure energy thereof while refrigerant jetted from the nozzle to an inlet of the pressure increasing portion and refrigerant drawn from the evaporator are mixed wherein:

the pressure increasing portion has a taper portion at least in a predetermined range from the inlet of the pressure increasing portion; and the taper portion is provided to increase a passage sectional area from the inlet of the pressure increasing portion toward an outlet of the pressure increasing portion; wherein the predetermined range of the taper portion is approximately equal to or larger than 10 times of the diameter at the inlet of the pressure increasing portion.

11. An ejector decompression device for a vapor compression refrigerant cycle that includes a compressor for compressing refrigerant, a refrigerant radiator for cooling refrigerant discharged from the compressor and an evaporator for evaporating low-pressure refrigerant after being decompressed, the ejector decompression device comprising:

a nozzle which decompresses refrigerant flowing out of the refrigerant radiator by converting pressure energy of the refrigerant to speed energy thereof; and a pressure increasing portion which increases a pressure of refrigerant by converting the speed energy of the refrigerant to the pressure energy thereof while refrigerant jetted from the nozzle to an inlet of the pressure increasing portion and refrigerant drawn from the evaporator are mixed, wherein:

the pressure increasing portion has a taper portion at least in a predetermined range from the inlet of the pressure increasing portion; and the taper portion is provided to increase a passage sectional area from the inlet of the pressure increasing portion toward an outlet of the pressure increasing portion; wherein the nozzle has a center axial line (L1) that is crossed with a center axial line (L2) of the pressure increasing portion by an offset angle (⊖); and a taper angle (α) of the taper portion is set to be equal to or larger than twice of the offset angle (⊖).

* * * * *